US007971513B2

(12) United States Patent
Chan

(10) Patent No.: US 7,971,513 B2
(45) **Date of Patent: *Jul. 5, 2011**

(54) PAPER PUNCH DIE AND PAPER PUNCH WITH SUCH A DIE

(75) Inventor: Kwok Ki Stephen Chan, New Territories (HK)

(73) Assignee: Lee Tack Plastic & Metal Manufactory, Ltd., Hong Kong (CN)

( * ) Notice: Subject to any disclaimer, the term of this patent is extended or adjusted under 35 U.S.C. 154(b) by 489 days.

This patent is subject to a terminal disclaimer.

(21) Appl. No.: 11/669,981

(22) Filed: Feb. 1, 2007

(65) Prior Publication Data

US 2008/0184862 A1 Aug. 7, 2008

(51) Int. Cl.
*B26F 1/14* (2006.01)

(52) U.S. Cl. ..... 83/621; 83/686; 83/698.91

(58) Field of Classification Search ..... 83/686, 83/698.91, 621, 633, 628, 588, 167; 30/315, 30/316, 280, 113.1, 133.3, 314, 301
See application file for complete search history.

(56) References Cited

U.S. PATENT DOCUMENTS

| | | | | |
|---|---|---|---|---|
| 3,373,643 | A * | 3/1968 | Spengler | 83/620 |
| 6,000,139 | A * | 12/1999 | Chan | 30/358 |
| 6,089,137 | A * | 7/2000 | Lee | 83/686 |
| 6,711,977 | B2 * | 3/2004 | Tsai | 83/686 |
| 6,739,244 | B1 * | 5/2004 | Carbaugh | 83/684 |
| 2003/0070523 | A1 * | 4/2003 | Lin | 83/686 |
| 2004/0129124 | A1 * | 7/2004 | Chan | 83/686 |
| 2008/0168877 | A1 * | 7/2008 | Chan | 83/685 |

* cited by examiner

*Primary Examiner* — Stephen Choi
(74) *Attorney, Agent, or Firm* — William J. Sapone; Coleman Sudol Sapone P.C.

(57) ABSTRACT

A paper punch die (125) is disclosed as including a top part (110, 202, 302) and a platform (100, 206, 306) engaged with each other, the platform (100, 206, 306) having an upper major surface (106) and a lower major surface (126, 207, 307), the upper major surface of the platform (100, 206, 306) being in abutment with a lower major surface (118) of the top part (110, 202, 302), and an endless wall (130) with an undulating cutting edge (132) extending away from the lower major surface (126, 207, 307) of the platform (100, 206, 306). There is also disclosed a paper punch (140) including such a paper punch die (125).

13 Claims, 14 Drawing Sheets

PAPER PUNCH DIE AND PAPER PUNCH WITH SUCH A DIE

This invention relates to a paper punch die and a paper punch with such a die, in particular such a die and a paper punch suitable for paper crafting purposes.

BACKGROUND OF INVENTION

In the field of paper crafting, pieces of paper or cardboard of various shapes are punched out from sheets of paper or cardboard by paper punches. A conventional paper punch is shown in FIGS. 1 and 1A and generally designated as 10. The paper punch 10 has a lever 12 operatively associated with a main body 14. A generally horizontal slot 16 is provided in the main body 14 for insertion of a sheet of paper or cardboard 18. The lever 12 may then be pivoted downwardly to move a die (not shown in FIG. 1, 1A or 2) to punch or cut out a piece of shaped paper or cardboard 18*a* from the piece of paper or cardboard 18, as shown in FIG. 2.

As shown in FIG. 3, the punch 10 has a die 20 with an upper flat plate 26 which is operatively associated with the lever 12. The die 20 is integrally formed with an endless, downwardly-depending wall 28. On an underside of the wall 28 is formed an undulating cutting edge 30. The punch 10 also has a die holder 24 with an upper jaw 31 and a lower jaw 32 which are joined at a rear end 34 thereof. A piece of paper or cardboard may therefore be inserted through a slot 35 between the upper and lower jaws 31, 32 of the die holder 24. Each of the upper and lower jaws 31, 32 is formed with a hole which are aligned with each other and are so shaped and sized to just allow the wall 28 of the die 20 to pass through. Thus, when a piece of paper or cardboard is received within the slot 16 of the punch 10, and thus within the slot 35 of the die holder 24, upon downward movement of the lever 12, the cutting edge 30 of the die 20 will shear the piece of paper or cardboard to punch or cut out a piece of shaped paper or cardboard.

In conventional paper punches, both the die and the die holder are made of metal or metal alloy (such as copper, aluminium, silver, zinc or tin) by low pressure die cast, e.g. by injection moulding. Although the cost of the paper punches may be reduced if at least part of the die or die holder is made of a plastics material, it has long been held by people in the field that such would jeopardize the proper alignment between the die and the die holder, in particular during the course of relative movement between the die and the die holder in the punching action. It is also believed that the strength and rigidity of the die may be compromised if part of it is made of a plastics material. In particular, as the die is made integrally of a metal or metal alloy, if, after prolonged use, part of the die (e.g. the cutting edge) is damaged, the whole die has to be disposed of or re-cast, which is not economical.

It is thus an object of the present invention to provide a paper punch die and a paper punch in which at least one of the aforesaid shortcomings is mitigated, or at least to provide a useful alternative to the trade and public.

SUMMARY OF THE INVENTION

According to a first aspect of the present invention, there is provided a paper punch die including a first body part and a second body part engaged with each other, wherein said second body part has a first major surface and a second major surface, wherein said first major surface of said second body part is in abutment with a first side of said first body part, and wherein an endless wall member with an undulating cutting edge extends away from said second major surface of said second body part.

According to a second aspect of the present invention, there is provided a paper punch including a paper punch die, a die holder, and an operating member operable to move said die relative to said die holder to punch at least a piece of paper received within said paper punch, wherein said die includes a first body part and a second body part engaged with each other, wherein said second body part has a first major surface and a second major surface, wherein said first major surface of said second body part is in abutment with a first side of said first body part, and wherein an endless wall member with an undulating cutting edge extends away from said second major surface of said second body part.

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENTS

Figure 1:
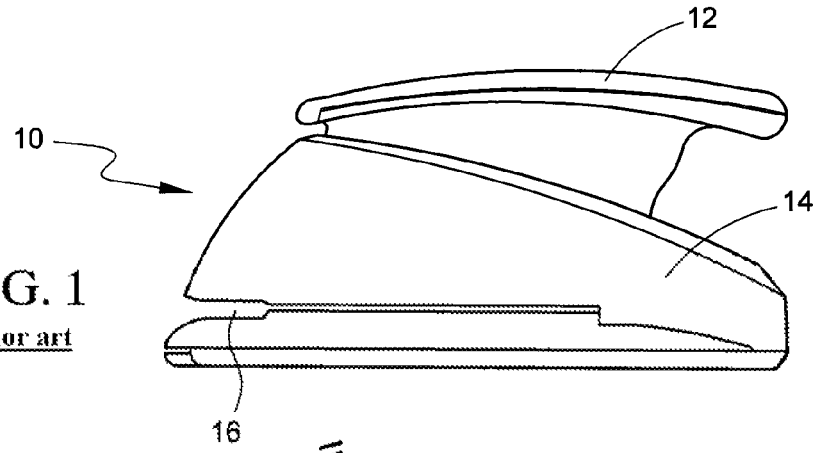
FIG. 1 Prior art
FIG. 1 is a side view of a conventional paper punch.
Figure 1A:
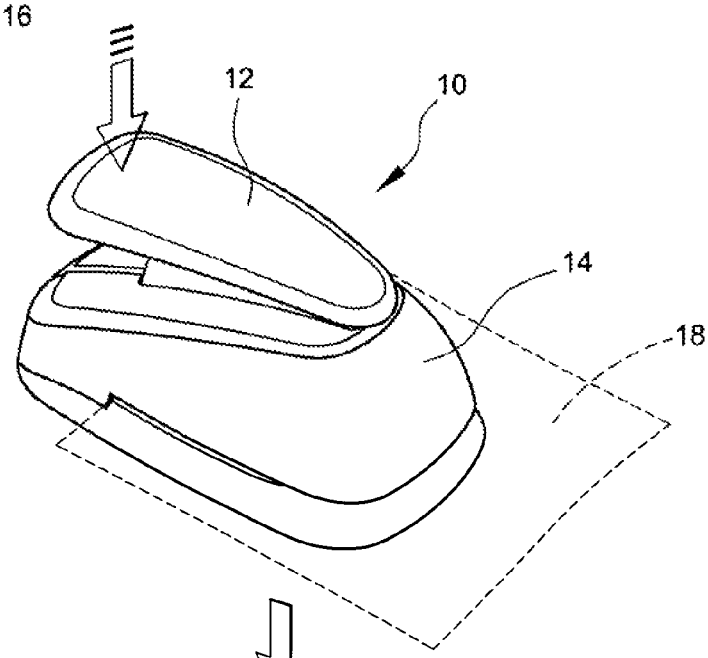
FIG. 1A Prior art
FIG. 1A is a top perspective view of the paper punch shown in FIG. 1.

Although the present invention will hereinafter be referred to as and described in the context of a paper punch die and a paper punch with such a die, it is envisaged that the present invention is also suitable for pinching cardboard and such like paper materials, and that the scope of protection should be construed accordingly.

As shown in FIGS. 4 to 8, a circular metal or metal-alloy (e.g. cast iron) platform forming part of a paper punch die according to a first preferred embodiment of the present invention is generals designated as 100. Along a periphery 102 of the platform 100 are equi-distantly and equi-angularly provided four generally rectangular extensions 104 which extend upwardly away from an upper major surface 106 of a circular plate 107 of the platform 100. Four holes 108 are provided through the plate 107 of the platform 100.

Turning now to FIGS. 9 to 12, such show a top part 110 forming part of a paper pinch die according to a first preferred embodiment of the present invention. The top part 110 may be made of metal, metal alloy or a plastics material, such as acrylonitrile-butadiene-styrene (ABS). The top part 110 has a center portion 111 with an upper surface 112. The centre portion 111 is joined, with side walls 114 by a number of ribs 116.

The lower surface 118 of the top part 110 is flat and also has four through holes 120, which are sized, shaped and positioned to correspond to the holes 108 of the platform 100. Along the side walls 114 are four generally rectangular recesses 122 shaped, sized and positioned to each receive at least part of a respective extension 104 of the platform 100.

Figure 13:
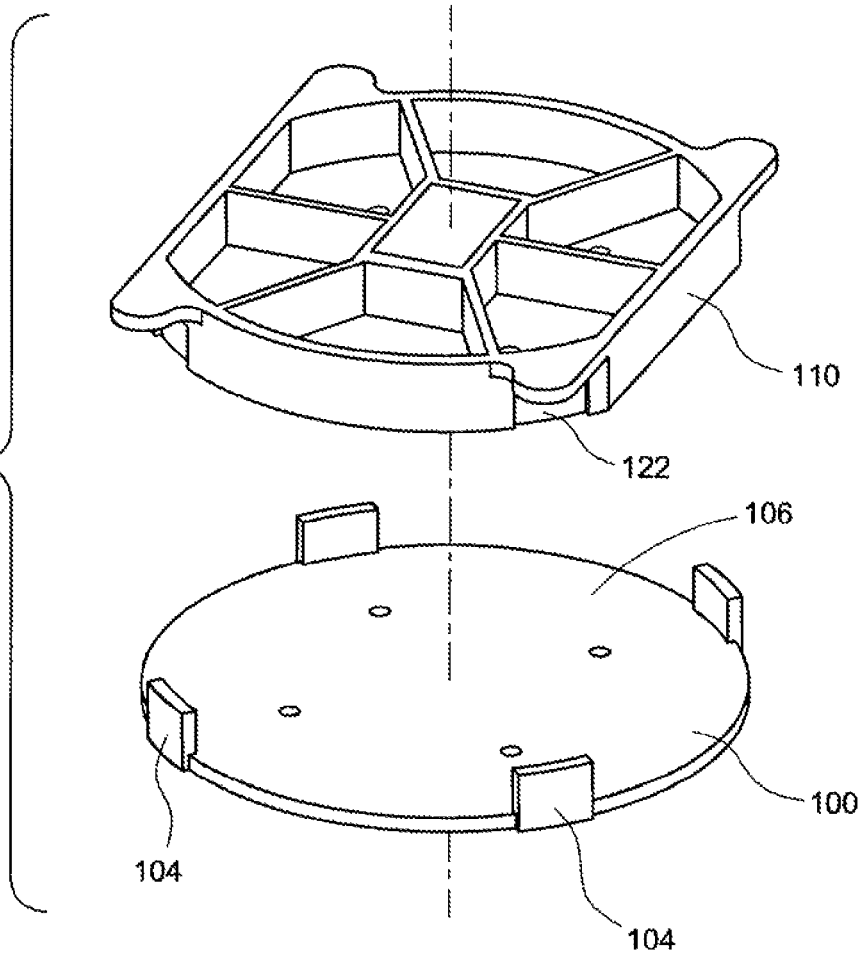
FIG. 13 is an exploded perspective view of the platform shown in FIG. 4 and the top part shown in FIG. 9, forming part of the paper punch die according to the first preferred embodiment of the present invention.
Figure 14:
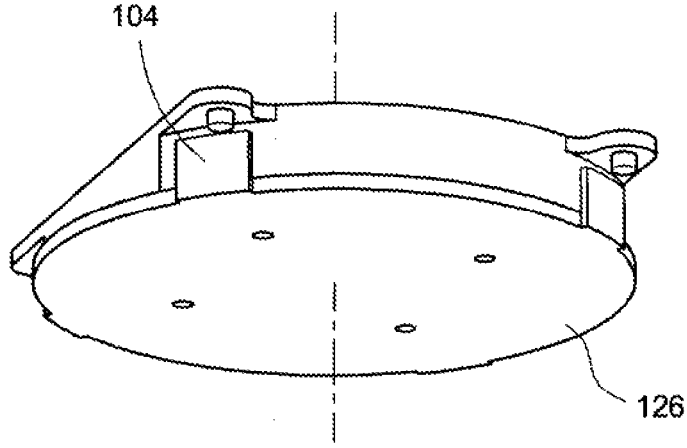
FIG. 14 is an assembled view of the platform and top part shown in FIG. 13.

As shown in FIGS. 13 and 14, when the platform 100 and the top part 110 are engaged within each other such that the upper major surface 106 of the platform 100 is in abutment with the lower surface 118 of the upper part, the holes 120 of the top part 110 are in alignment with the holes 108 of the platform 100, and the extensions 104 of the platform 100 are received partly within the recesses 122 of the top part 110. Four screws (not shown) are threadedly engaged with the holes 108 and the holes 120 to fixedly engage the platform 100 and the top part 110 with each other.

Figure 15:
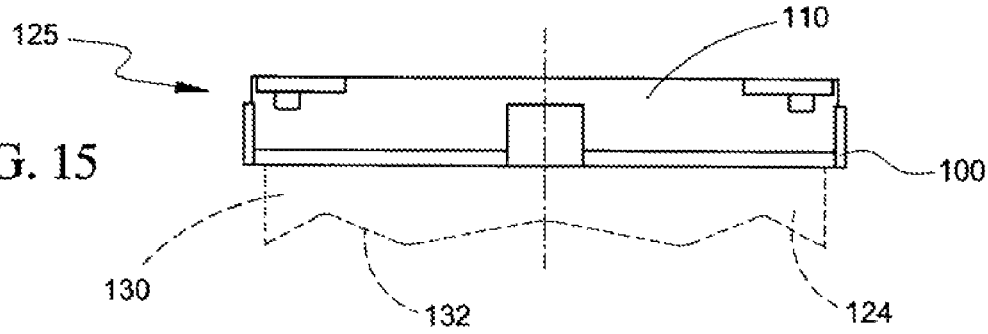
FIG. 15 is a side view of the paper punch die according to the first preferred embodiment of the present invention.
Figure 16:
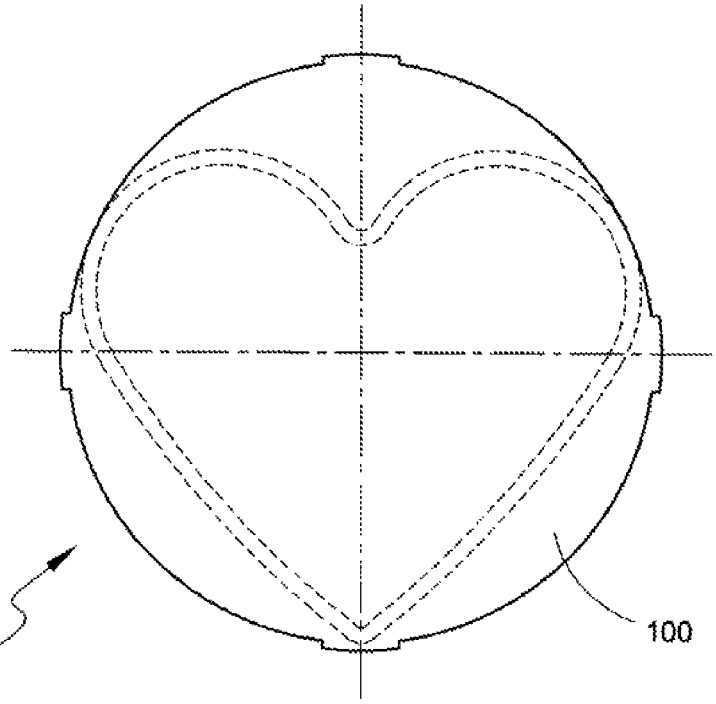
FIG. 16 is a bottom view of the paper punch die shown in FIG. 15.
Figure 17:
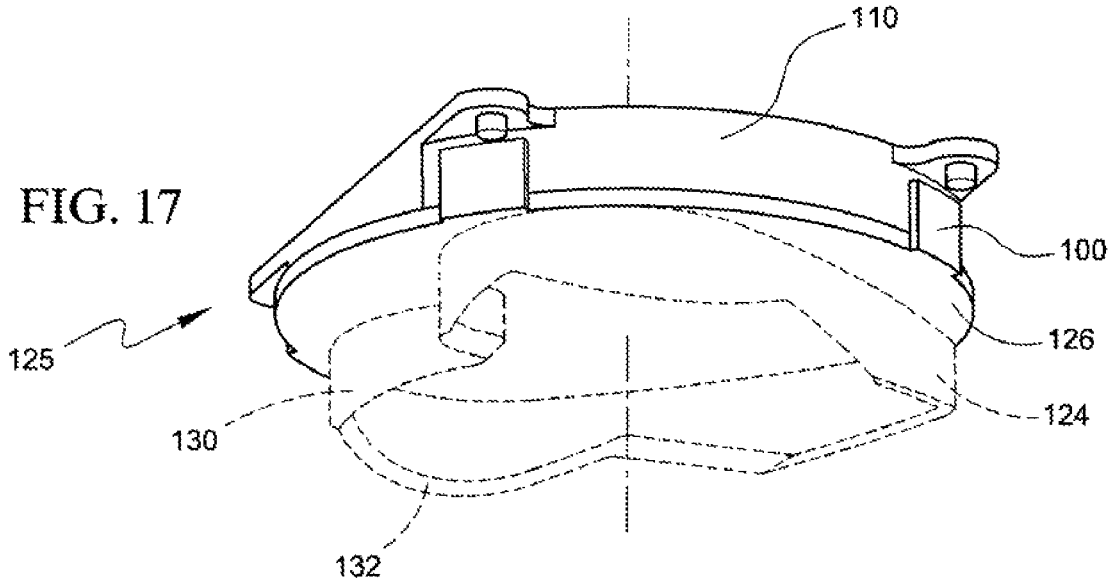
FIG. 17 is a bottom perspective view of the paper punch die shown in FIG. 15.

As shown in FIGS. 15 to 17, a cutting portion 124 (shown here in dotted lines) is built to extend from a lower major surface 126 of the platform 100 to form a paper punch die 125. The cutting portion 124 is made of a metal or metal alloy, with an endless wall 130 with an undulating cutting edge 132. Such a punch die is for cutting pieces of paper in a heart shape.

Figure 18:
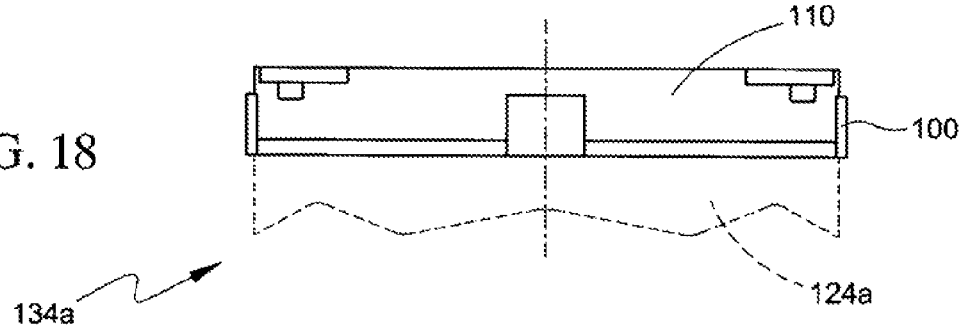
FIG. 18 is a side view of a paper punch die according to a second preferred embodiment of the present invention.
Figure 19:
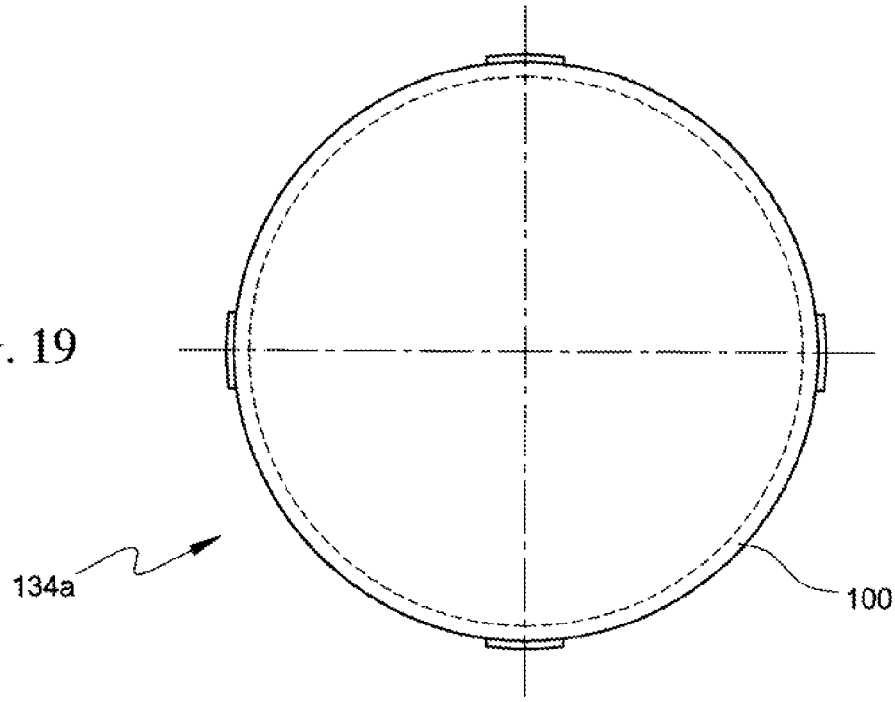
FIG. 19 is a bottom view of the paper punch die shown in FIG. 18.
Figure 20:
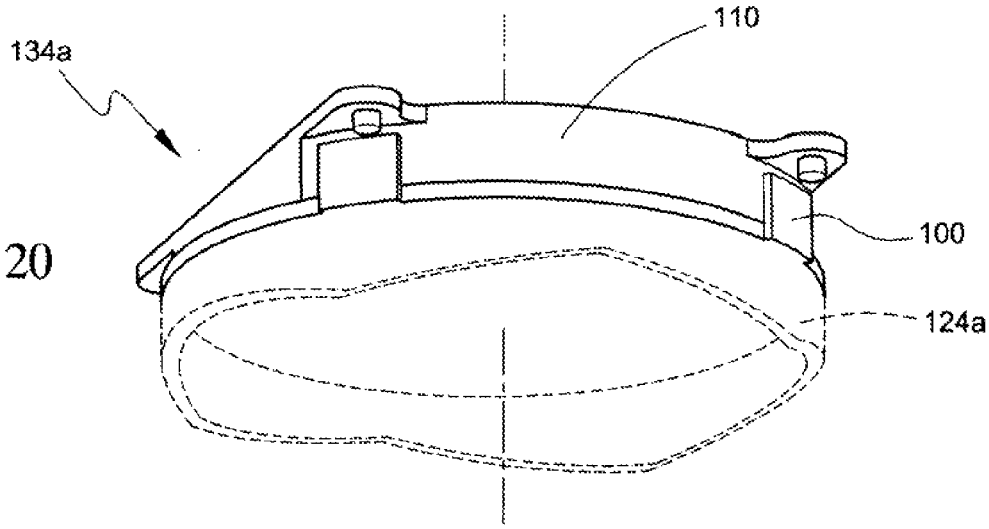
FIG. 20 is a bottom perspective view of the paper punch die shown in FIG. 18.
Figure 21:
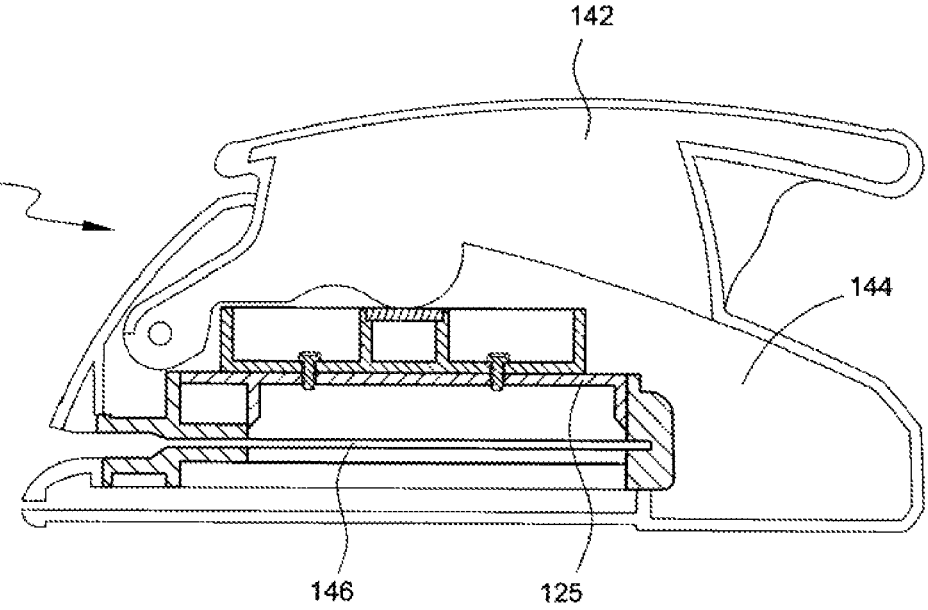
FIG. 21 is a sectional view of a paper punch incorporated with the paper punch die shown in FIG. 17.
Figure 22:
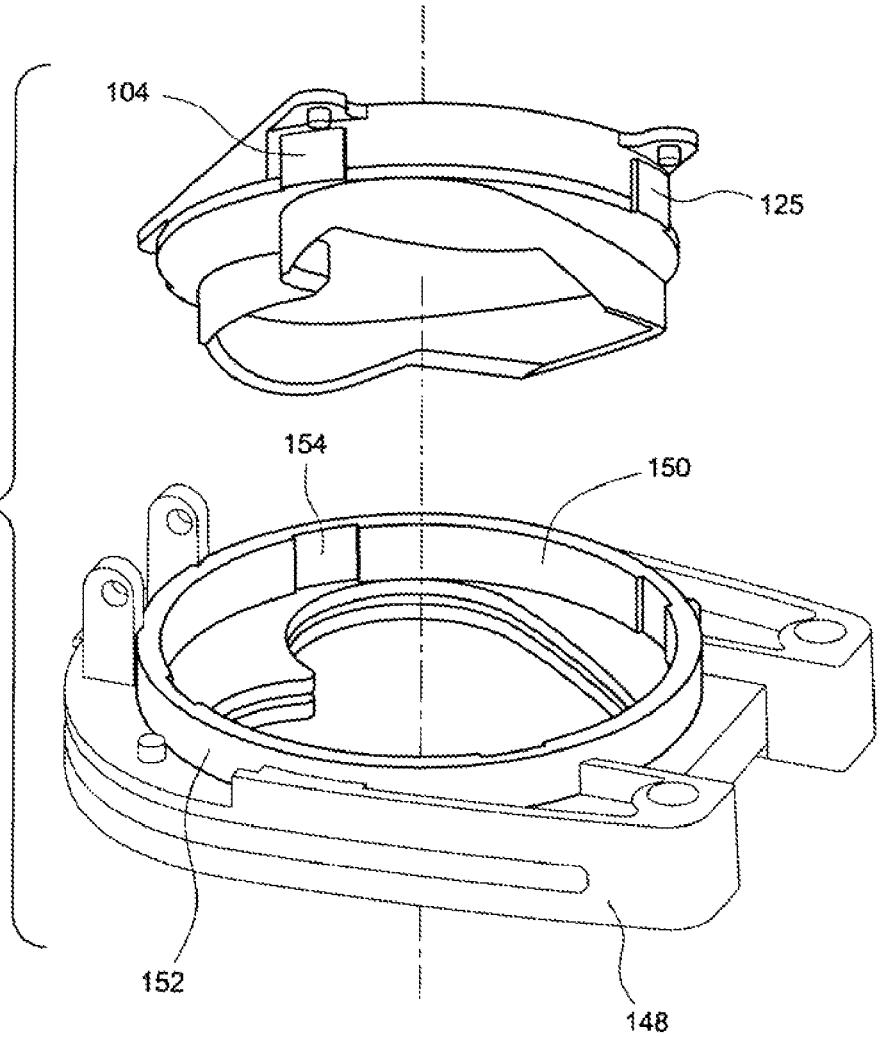
FIG. 22 is an exploded view of the paper punch die shown in FIG. 17 with a die holder, being part of the paper punch shown in FIG. 21.

With the same top part 110 and platform 100, a cutting portion 124*a* of a different shape may be built, as shown in FIGS. 18 to 20, for forming a die part 134*a*. Such a punch die is for cutting pieces of paper in circle.

It can be seen that, with such an arrangement, cutting portions of different shapes may be built on the same standard and universal top part 110 and platform 100. Such can significantly simplify the moulding and production process. In addition, as the top part 110 may be made of a plastics material, the production cost can also be reduced.

Figure 2:
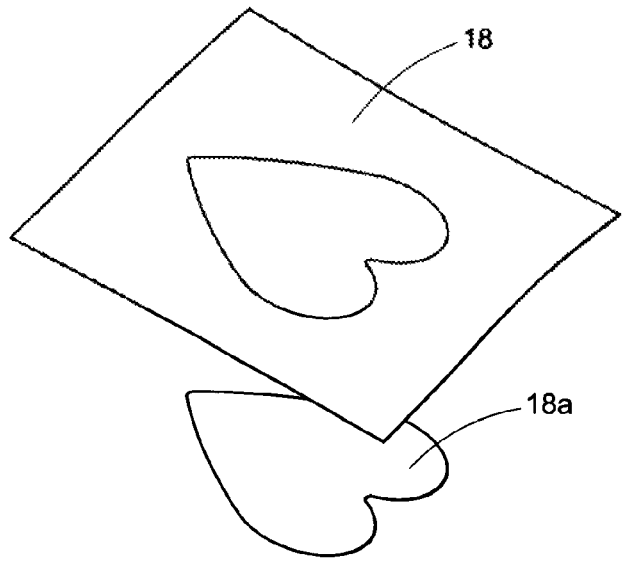
FIG. 2 Prior art
FIG. 2 shows a piece of shaped paper as cut out from a sheet of paper by the conventional paper punch of FIGS. 1 and 1A.
Figure 3:
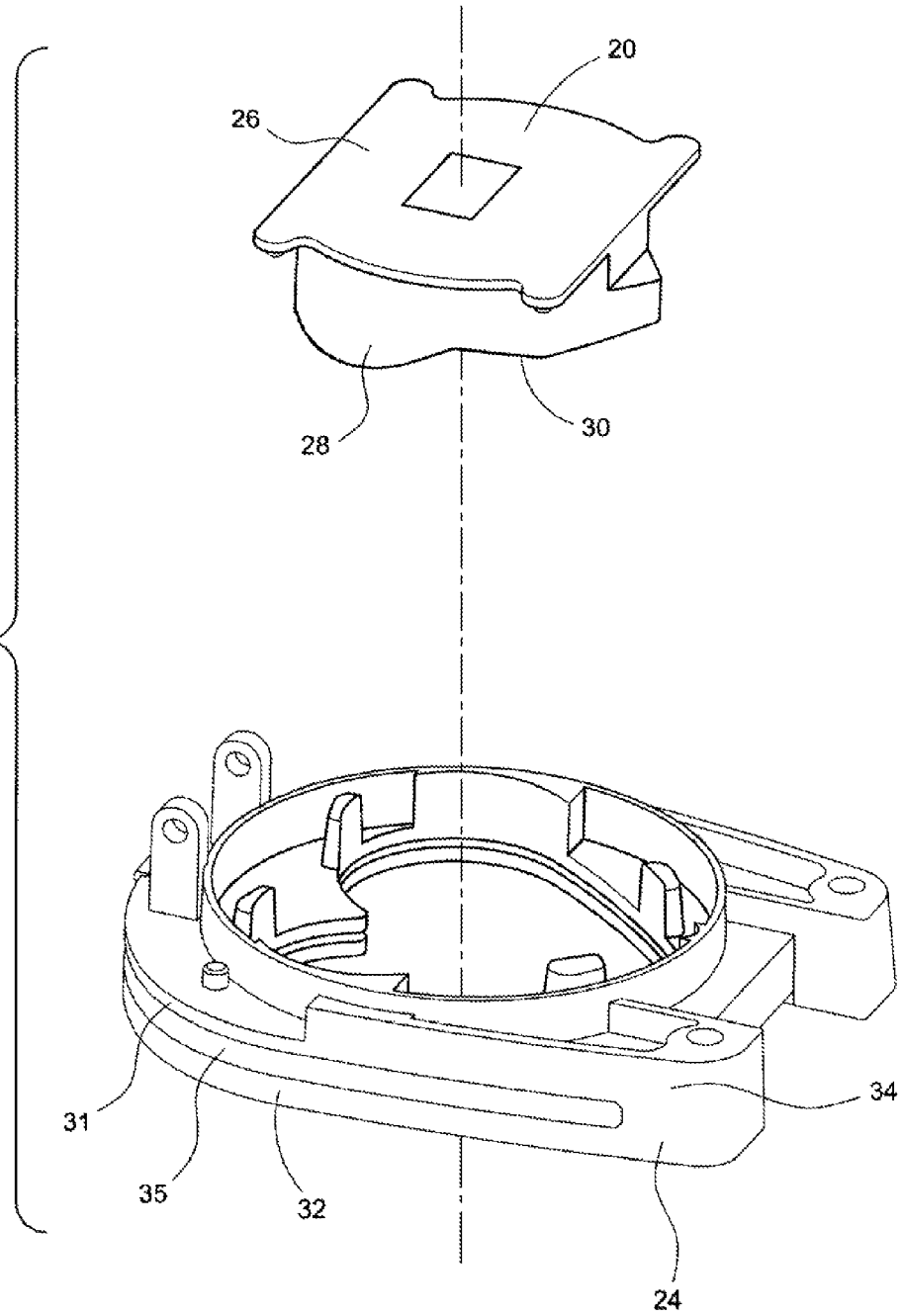
FIG. 3 ( PRIOR ART )
FIG. 3 is an exploded view of a conventional die and die holder arrangement.
Figure 4:
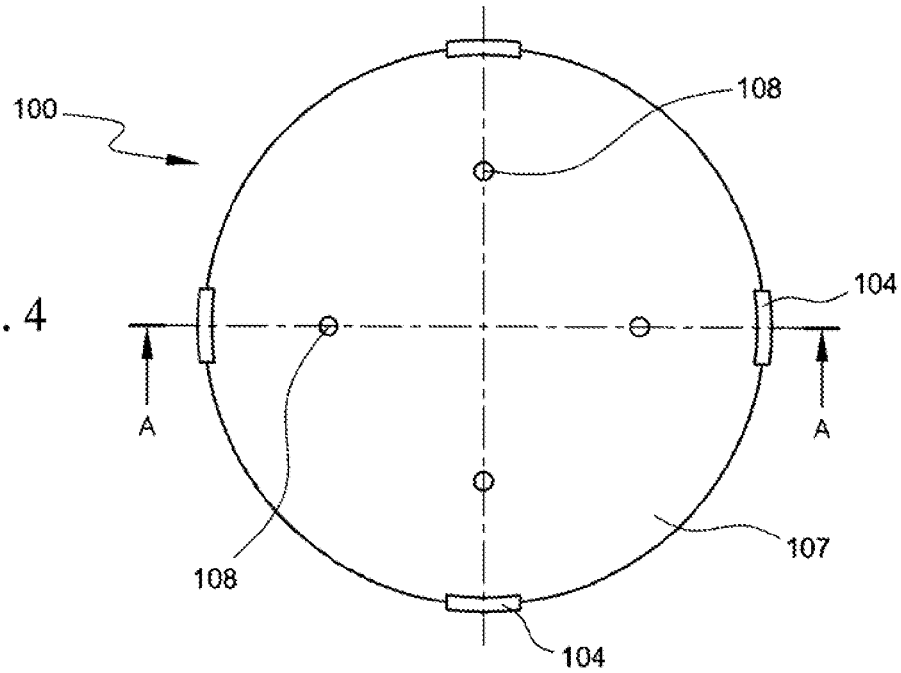
FIG. 4 is a top view of a circular platform forming part of a paper punch die according to a first preferred embodiment of the present invention.
Figure 5:
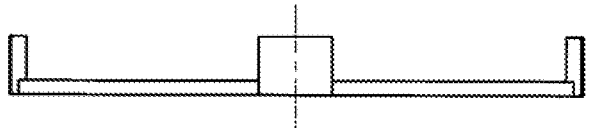
FIG. 5 is a side view of the platform shown in FIG. 4.
Figure 6:
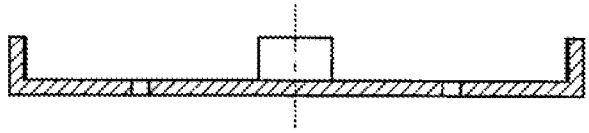
FIG. 6 is a sectional view taken along the line A-A in FIG. 4.
Figure 7:
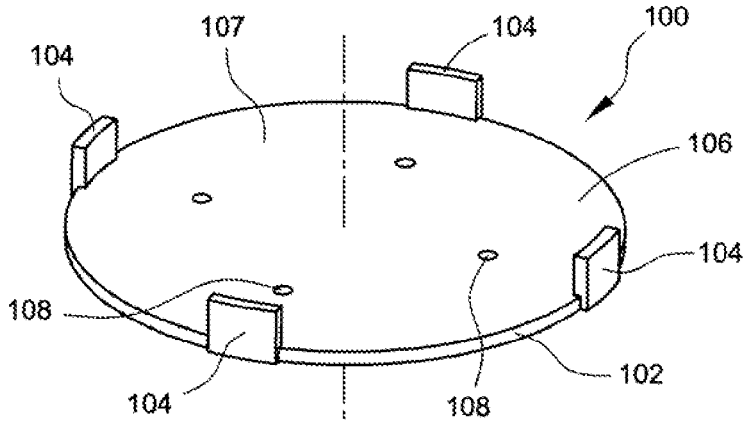
FIG. 7 is a top perspective view of the platform shown in FIG. 4.
Figure 8:
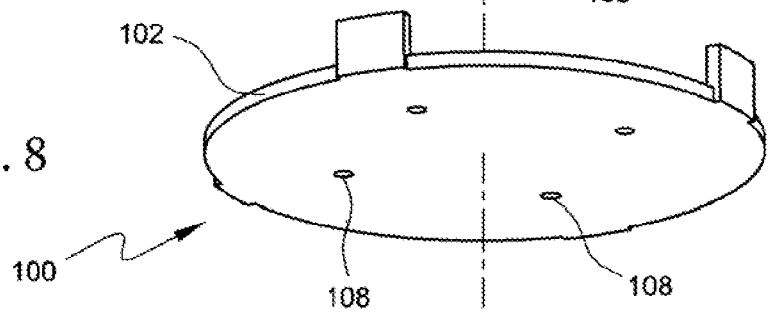
FIG. 8 is a bottom perspective view of the platform shown in FIG. 4.
Figure 9:
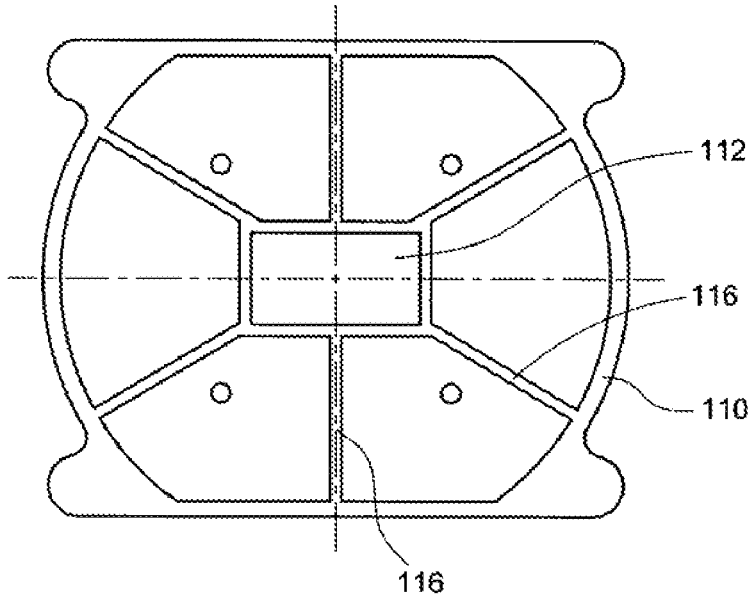
FIG. 9 is a top view of a top part forming part of the paper punch die according to the first preferred embodiment of the present invention.
Figure 10:
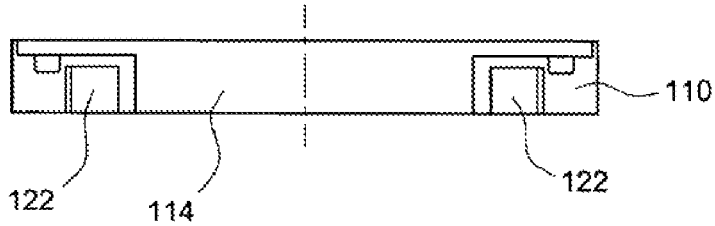
FIG. 10 is a side view of the top part shown in FIG. 9.
Figure 11:
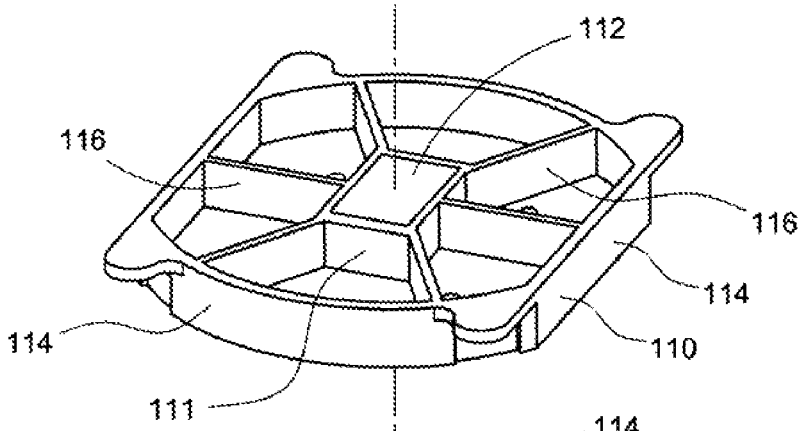
FIG. 11 is a top perspective view of the top part shown in FIG. 9.
Figure 12:
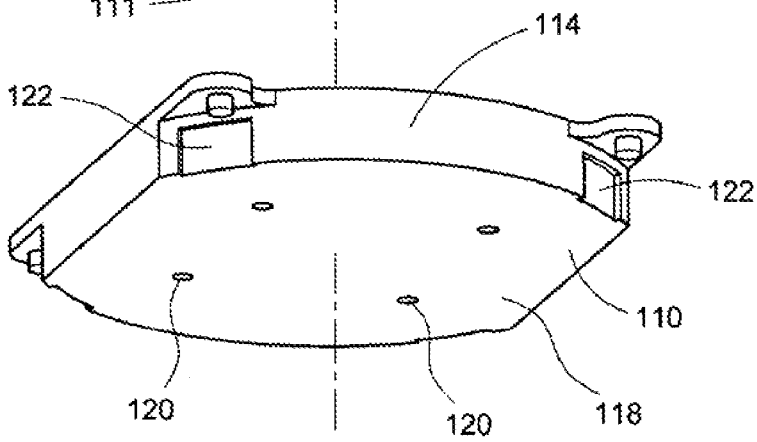
FIG. 12 is a bottom perspective view of the top part shown in FIG. 9.
Figure 23:
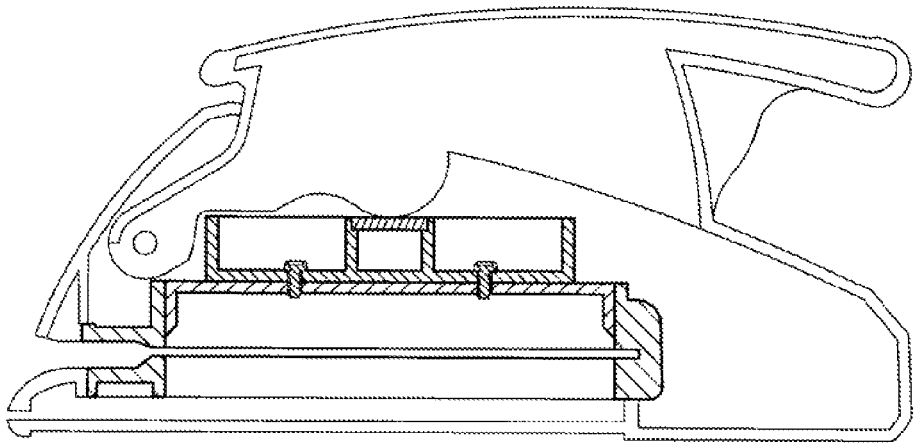
FIG. 23 is a sectional view of a paper punch incorporated with the paper punch die shown in FIG. 20.
Figure 24:
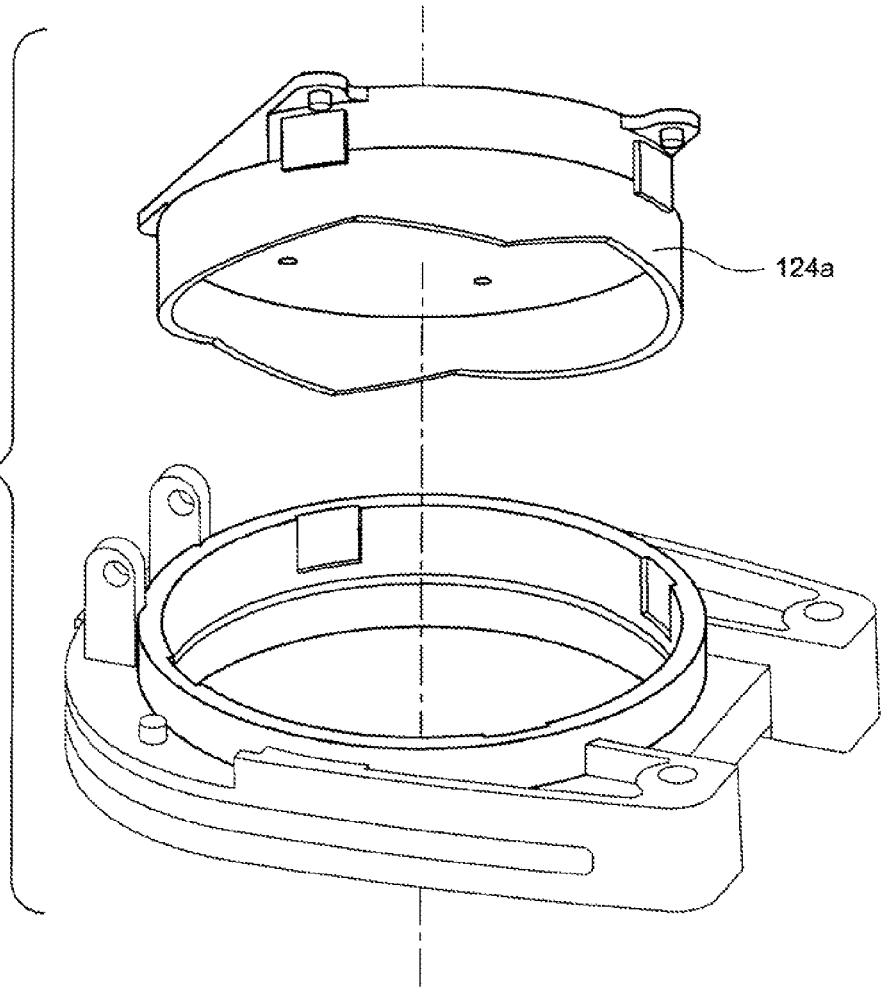
FIG. 24 is an exploded view of the paper punch die shown in FIG. 20 with a die holder, being part of the paper punch shown in FIG. 23.

A paper punch incorporating the paper punch die 125 is shown in FIG. 2 and generally designated as 140. The paper punch 140 has a lever 142 operatively associated with a main body 144. A generally horizontal slot 146 is provided in the main body 144 for insertion of a sheet of paper or cardboard. The lever 142 may then be pivoted downwardly to bear on the upper surface 112 of the centre portion 111 of the top part 110 to move the die 125 to punch or cut out a piece of shaped paper or cardboard. In order to ensure proper alignment between the die 125 and a die holder 148, along an inner side 150 of a circular wall 152 of the die holder 148 are equi-distantly and equi-angularly provided for recesses 154 each for receiving at least part of the extensions 104 for relative sliding movement. As shown in FIG. 23, a paper punch may be formed with the same general structure, with the same top part 110 and platform 100, with which the cutting portion 124*a* is formed, for cutting pieces of paper or cardboard of a different shape, e.g. circular.

Each pair of extensions 104 and recesses 154 remain in contact with each other during the entire punching, and return movement of the die 125 relative to the die holder 148. Such ensures that the die 125 and the die holder 148 are property aligned with each other, thus preventing crashing of the cutting edge 132 with the die holder 148. With such an arrangement, cutting portions for punching pieces of paper or more complicated patterns or shapes may be provided more easily.

Figure 25:
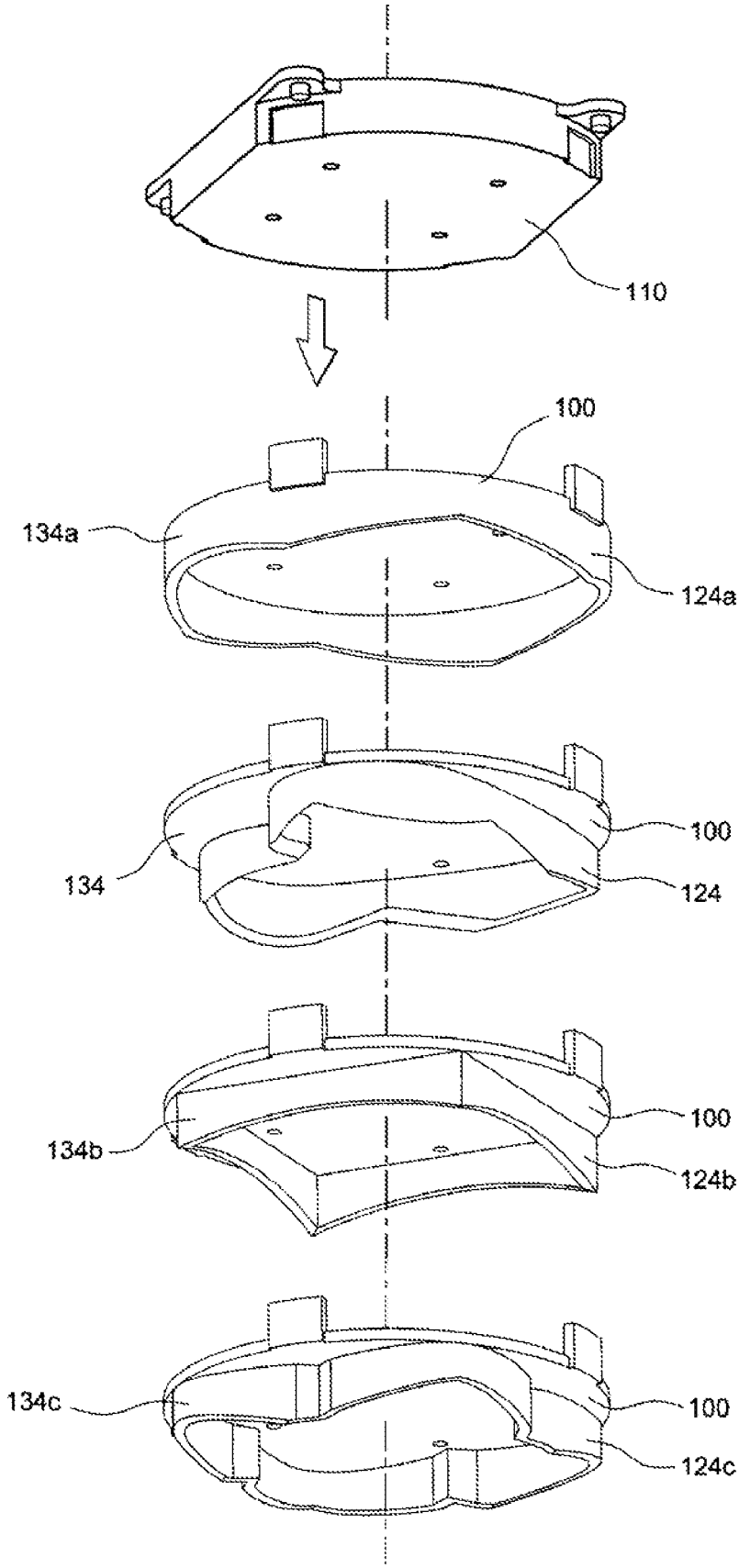
FIG. 25 shows possible assembly of tie top part shown in FIG. 9 with a number of platforms with cutting portions of different shapes.
Figure 26:
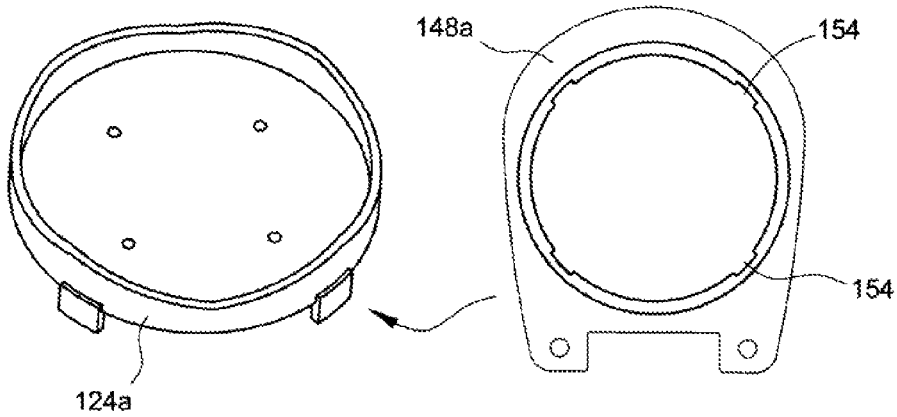
FIGS. 26 to 29 show paper punch die parts with cutting portions of different shapes, and a respective correspondingly shaped die holder.
Figure 27:
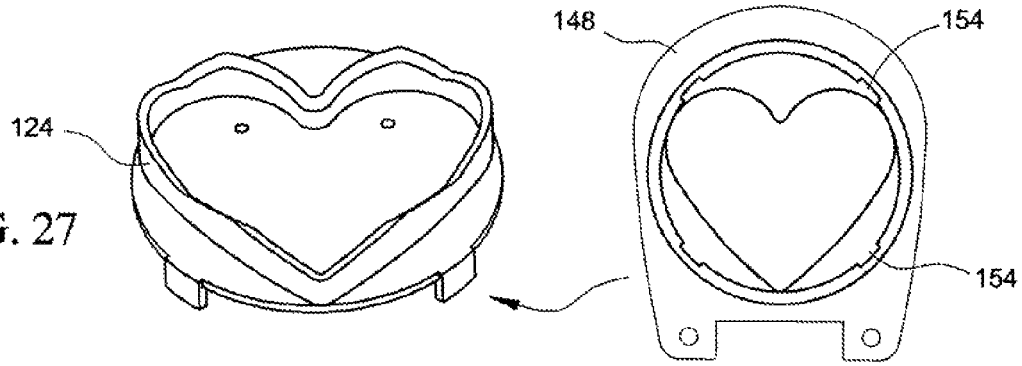
Figure 28:
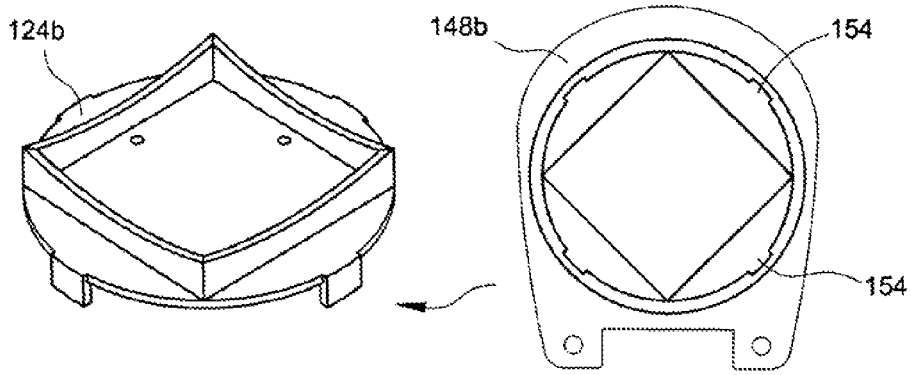
Figure 29:
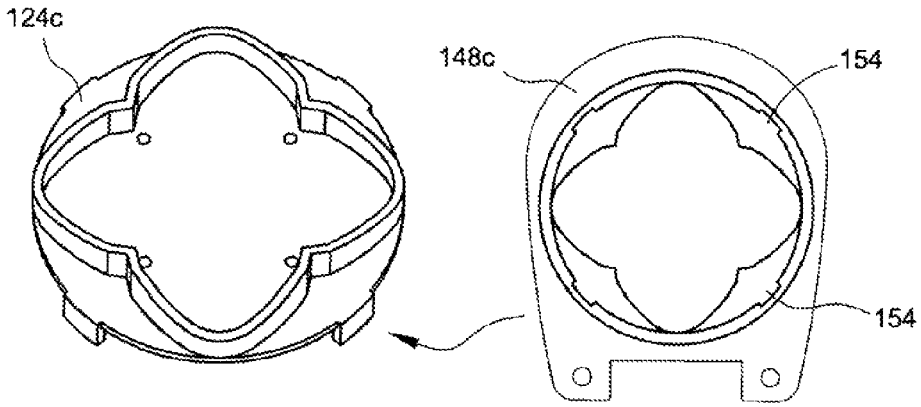

As further shown in FIG. 25, the same top part 110 may be selectively engaged with one of a number of different die parts 134, 134*a*, 134*b*, 134*c* which are formed of the same platform 100 but with different, cutting portions, for cutting out pieces of paper or cardboard of different shapes. The platform 100 may be formed with the circular cutting portion 124*a* for cutting out circular pieces of paper or cardboard, with the heart-shaped cutting portion 124, with a cutting portion 124*b* for cutting out square pieces of paper, or with a cutting portion 124*c* for cutting out pieces of paper or cardboard in the shape of a four-leaf clover.

As can be seen in FIGS. 26 to 29, with different die parts 134, 134*a*, 134*b*, 134*c*, in the respective die holders 148, 148*a*, 148*b*, 148*c*, only the central holes through which the cutting portions 124, 124*a*, 124*b*, 124*c* are required to be correspondingly shaped. The structure and shape of all other parts remain the same. In particular, the positioning, size and shape of the recesses 154 are the same in all the die holders 148, 148*a*, 148*b*, 148*c*. Again, the design, moulding and manufacture of the die holders are significantly simplified and standardized.

Figure 30:
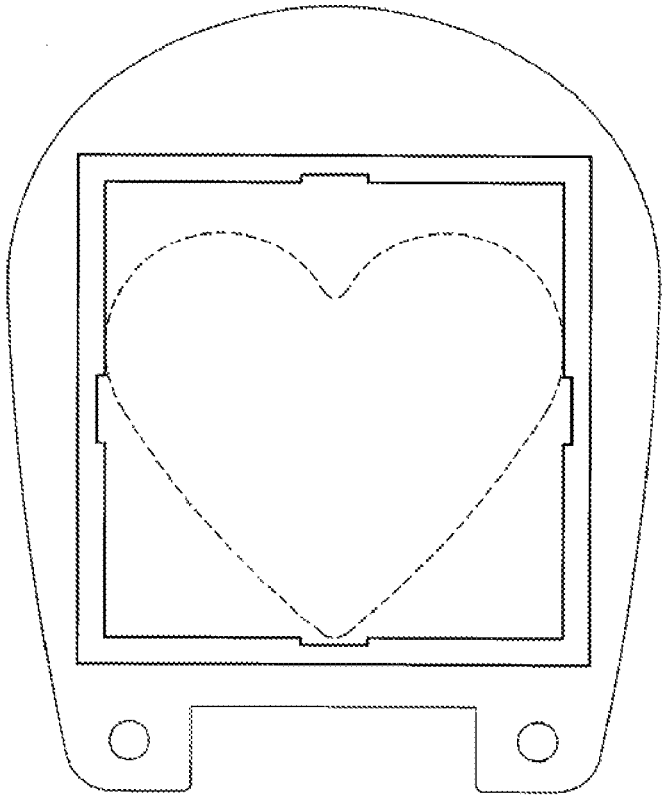
FIGS. 30 and 31 show paper punch dies with platforms of different shapes, and a respective correspondingly shaped die holder.
Figure 31:
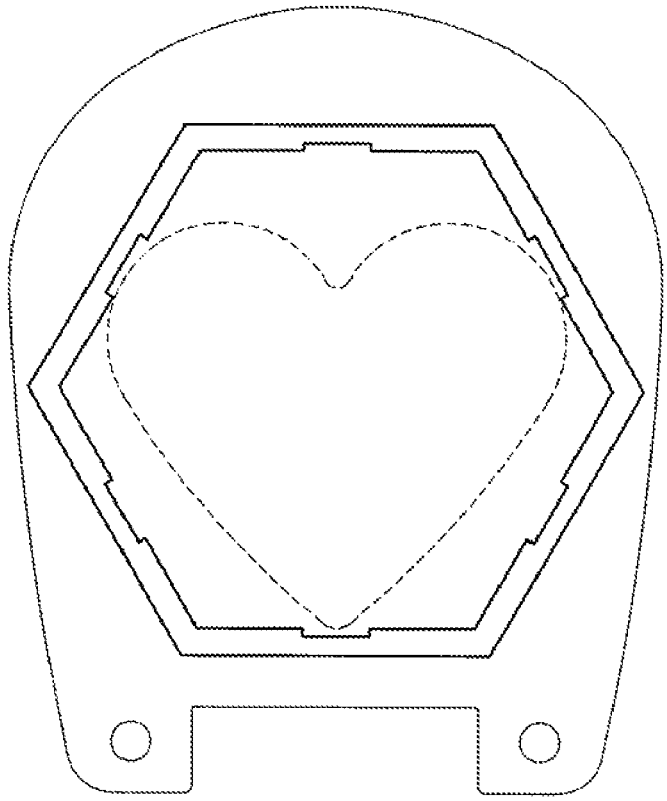

Although the invention has thus far been described with a circular universal platform 100, it is envisaged that the platform may be of other shapes, such as square or regular hexagonal in shape, as shown in FIGS. 30 and 31.

Figure 32:
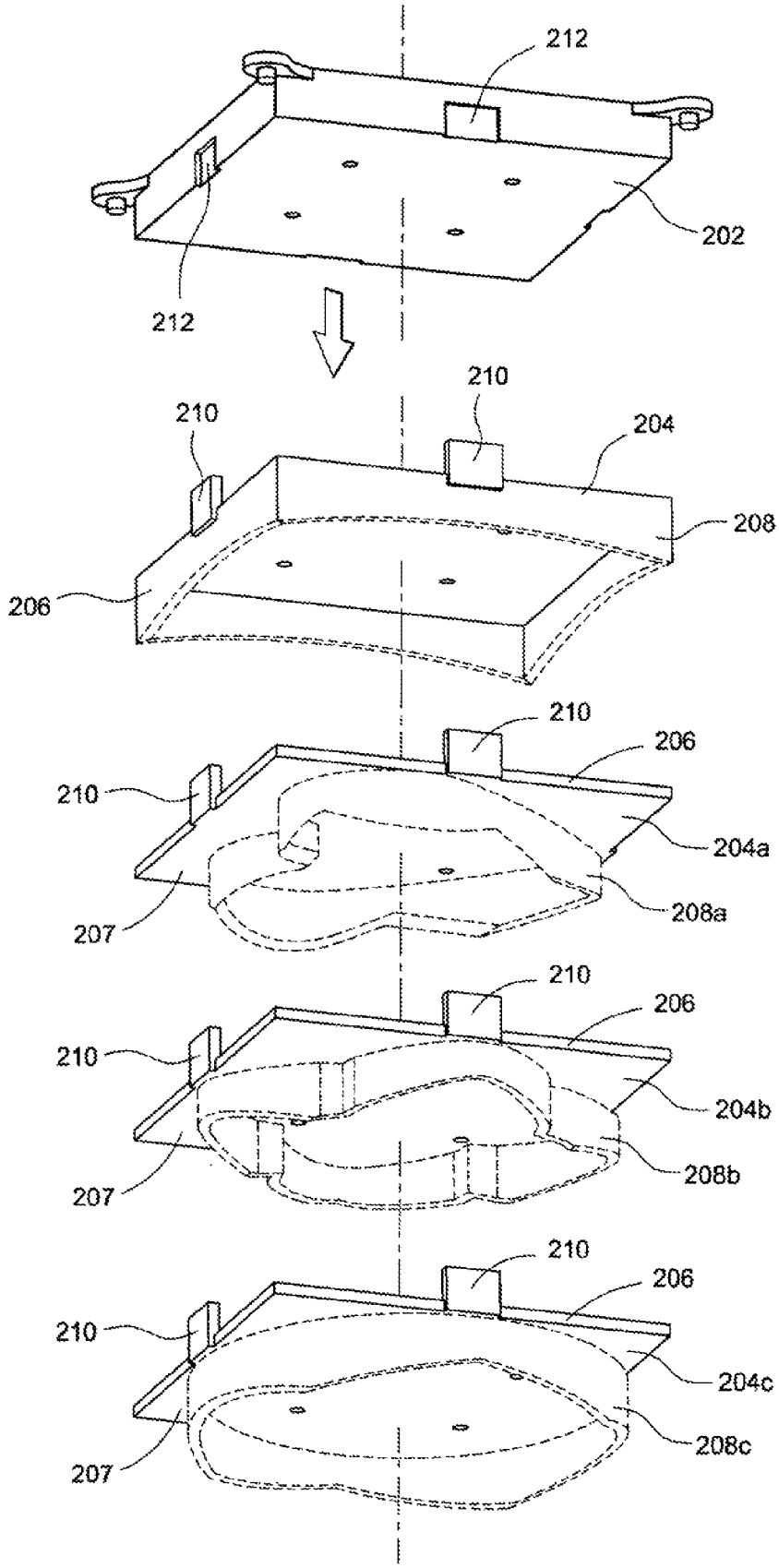
FIG. 32 shows a differently shaped top part engageable with a number of platforms with cutting portions of different shapes.

Thus, as further shown in FIG. 32, a square top part 202 may be selectively engaged with one of a number of different die parts 204, 204*a*, 204*b*, 204*c*, each formed of a same square platform 206 on a lower major surface 207 of which a respective cutting portion 208, 208*a*, 208*b*, 208*c* of different shapes is formed, for cutting out pieces of paper or cardboard in different shapes. Each of the die parts 204, 204*a*, 204*b*, 204*c* has four extensions 210, each partly received within a respective recess 212 on a periphery of the top part 202.

Figure 33:
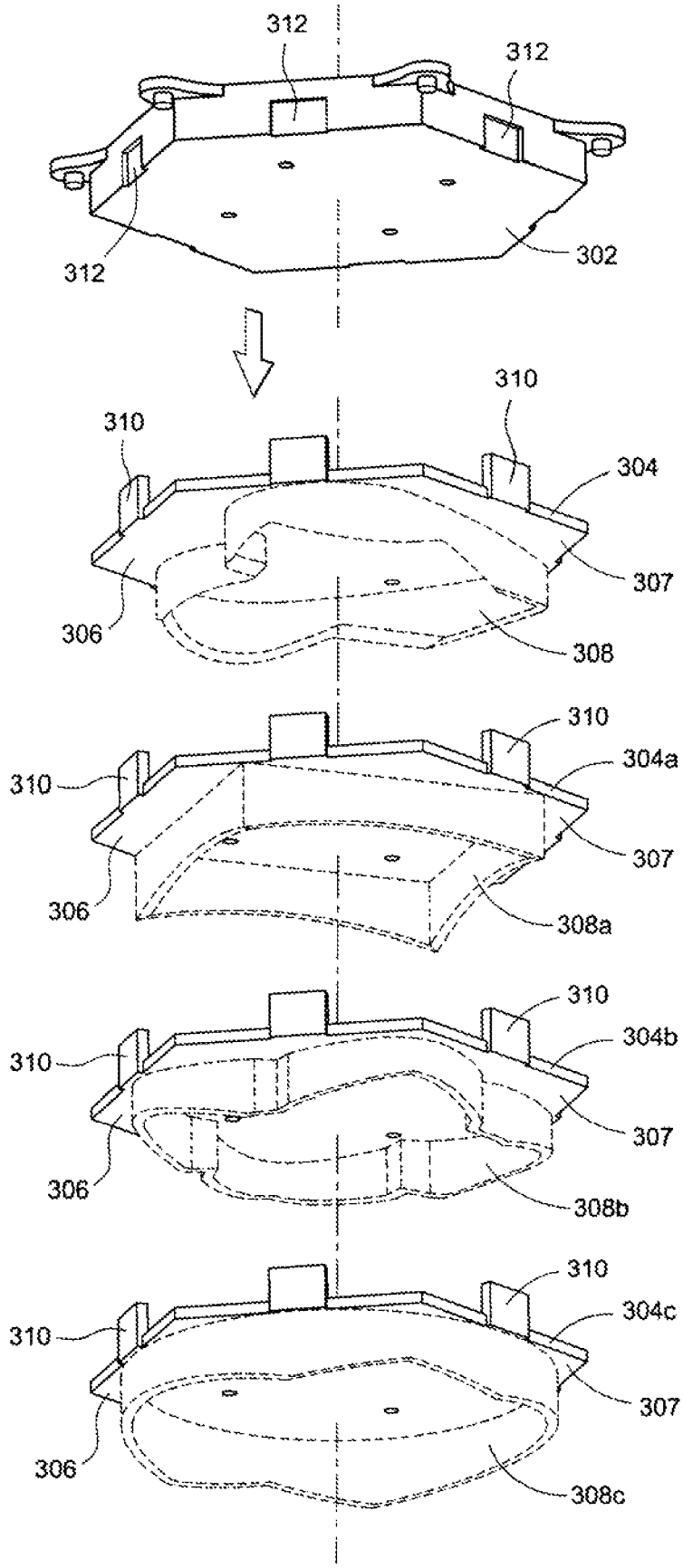
FIG. 33 shows a further differently shaped top part engageable with a number of platforms with cutting portions of different shapes.

Similarly, as shown in FIG. 33, a regular hexagonal top part 302 may be selectively engaged with one of a number of different die parts 304, 304*a*, 304*b*, 304*c*, each formed of a same regular hexagonal platform 306 on a lower major surface 307 of which a respective cutting portion 308, 308*a*, 308*b*, 308*c* of different shapes is formed, for cutting out pieces of paper or cardboard in different shapes. Each of the die parts 304, 304*a*, 304*b*, 304*c* has six extensions 310, each partly received within a respective recess 312 on a periphery of the top part 302.

It should be understood that the above only illustrates examples whereby the present intention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. A paper punch die comprising:

a first body part and a second body part, said second body part having a first major surface, a second major surface, and a peripheral edge adjoining said first major surface and said second major surface, said first major surface of said second body part being in abutment with a first side of said first body part, an endless wall member with an undulating cutting edge extending downwardly away from said second major surface of said second body part, and wherein along the peripheral edge of said second body part there are provided a plurality of upwardly projecting extension members, the first body part having a side wall containing a plurality of corresponding recesses, each recess at least partly receiving at least one of the plurality of upwardly projecting extension members therein, to engage said first body part with said second body part.

2. A paper punch die according to claim 1 wherein said first body part is made of a plastics material.

3. A paper punch die according to claim 2 wherein said first body part is made of acrylonitrile-butadiene-styrene (ABS).

4. A paper punch die according to claim 1 wherein said first and second body parts are engaged with each other by engagement means.

5. A paper punch die according to claim 4 wherein said engagement means comprises a plurality of screws.

6. A paper punch die according to claim 1 wherein said second body part is made of a metal or metal alloy.

7. A paper punch including a paper punch die, a die holder, and an operating member operable to move said die relative to said die holder to punch at least a piece of paper received within said paper punch, wherein said die includes a first body part and a second body part engaged with each other, wherein said second body part has a first major surface, a second major surface, and a peripheral edge adjoining said first major surface and said second major surface, wherein said first major surface of said second body part is in abutment with a first side of said first body part, wherein an endless wall member with an undulating cutting edge extends downwardly away from said second major surface of said second body part, and wherein along the peripheral edge of said second body part, there are provided a plurality of upwardly projecting extension members, the first body part having a side wall containing a plurality of recesses, each recess at least partly receiving at least one of said plurality of upwardly projecting extension members therein, to engage said first body part with said second body part.

8. A paper punch according to claim 7 wherein said first body part is made of a plastics material.

9. A paper punch according to claim 8 wherein said first body part is made of acrylonitrile-butadiene-styrene (ABS).

10. A paper punch according to claim 7 wherein said first and second body parts are engaged with each other by engagement means.

11. A paper punch according to claim 10 wherein said engagement means comprises a plurality of screws.

12. A paper punch according to claim 7 wherein said second body part is made of a metal or metal alloy.

13. A paper punch according to claim 7 wherein each of said plurality of upwardly projecting extension members is slidably movable within and relative to the receiving recess therefore.

* * * * *